US005433098A

United States Patent [19]

Bowlin et al.

[11] Patent Number: 5,433,098

[45] Date of Patent: Jul. 18, 1995

[54] METHOD AND APPARATUS FOR INSIDE CAN BASE REFORMING

[75] Inventors: Geoffrey R. Bowlin, Lynchburg; Alexander A. Henzel, Forest, both of Va.

[73] Assignee: Belgium Tool and Die Company, Lynchburg, Va.

[21] Appl. No.: 189,241

[22] Filed: Jan. 31, 1994

[51] Int. Cl.[6] ..... B21D 51/26

[52] U.S. Cl. ..... 72/117; 72/122; 72/126

[58] Field of Search ..... 72/94, 110, 111, 117, 72/122, 123, 125, 126

[56] References Cited

U.S. PATENT DOCUMENTS

| | | | |
|---|---|---|---|
| 2,737,996 | 3/1956 | Toth | 72/123 |
| 4,399,679 | 8/1983 | King | 72/126 |
| 5,325,696 | 7/1994 | Jentzsch et al. | 72/117 |

*Primary Examiner*—Lowell A. Larson

*Attorney, Agent, or Firm*—Popham, Haik, Schnobrich & Kaufman, Ltd.

[57] ABSTRACT

An apparatus and method is shown for reforming the bottom of a container. A number of tooling rams each have a reforming roller supported by a roller mounting block that allows the reforming roller to travel along a circular orbital path of varying diameter in a plane perpendicular to the roller mounting block axis and having a center of curvature position coextensive with the container axis. Guide cams that slide along cam surfaces formed in slots in the roller mounting block are supported on a cam mounting block. The cam mounting block is supported on a tooling drive shaft that rotates the cam mounting block about its axis coextensive with the container axis while the tooling drive shaft is supported rotatably in and moved axially with a tooling ram that moves axially toward or away from the container. Axial and rotational movement of the cam mounting block is converted to radial and rotational movement of the reforming roller through the interaction of the guide cams with the roller mounting block.

6 Claims, 6 Drawing Sheets

METHOD AND APPARATUS FOR INSIDE CAN BASE REFORMING

BACKGROUND OF THE INVENTION

1. Field of the Invention

The present invention relates to a method and apparatus for forming an improved, reformed container bottom, with a result that the entire container is strengthened. Typically, this method and apparatus is used for reforming the bottoms of containers which have been formed of aluminum or other metal.

2. Related Art

U.S. Pat. No. 5,222,385 which is assigned to American National Can Company, Inc., (hereinafter referred to as the "ANC" patent) describes a method and apparatus for reforming the bottoms of drawn and ironed beverage containers. As stated in the ANC patent, which is herein incorporated by reference, the reforming of the can bottom results in an increase in the strength of the cans above that of prior art cans.

The apparatus of the ANC patent includes a jig for supporting a container along an outer annular wall of the container, and a reforming roller that is brought into engagement with a substantially vertical wall joining a central domed portion of the container to a convex U-shaped portion that defines a flange-like ridge on the bottom of the container. This apparatus requires the provision of spring biasing means to retract the rollers after their engagement with the container. Furthermore, separate and distinct means for moving the rollers in a radially outward direction to contact the can surface at the substantially vertical wall, and for driving the reforming rollers about an arcuate path during the reforming process, are required.

SUMMARY OF THE INVENTION

The primary object of the present invention is to provide a new and improved method and apparatus for reforming the bottom of a container. The present invention provides an improved version of a can bottom reformer that eliminates the need for a spring biasing means, that simplifies the design by providing a single means for driving the reforming roller along an arcuate path and for actuating the reforming roller radially outwardly, and that reduces variances in the dimensions of the reformed base of a container.

Can manufacturers are constantly striving to increase productivity by increasing the number of cans that are processed per unit of time—approaching 3600 cans per minute in some cases. Such high speed processing, in combination with a requirement to hold tolerances on can base dimensions to plus or minus 0.002 inch, necessitates a means for precisely controlling the movement of the reforming roller into and out of contact with the can base. The actuating means of the present invention provides such a means.

A preferred embodiment of the present invention includes a plurality of substantially identical processing stations. Each of these processing stations includes two facing turrets, namely, a tool turret and a feed turret. The tool turret has a plurality of circumferentially spaced tooling rams, each of which has a rotating cam mounting block that supports two radially extending skewed positioner cams and two parallel guide blocks, which are in turn engaged with slots in a roller mounting block that supports a reforming roller. The other of the facing turrets has a plurality of circumferentially spaced can push rams, each of which is in alignment with a respective tooling ram. A main starwheel is fixed between the two facing turrets and rotates in synchronism with them. Additionally, in-feed and out-flow starwheels are provided radially outwardly from the main starwheel and provide means for quickly and effectively transferring can bodies to and from the main starwheel between the two facing turrets. Details of a method and apparatus for transferring can bodies to and from the plurality of identical processing stations are described in pending U.S. patent application Ser. No. 08/069,006, (hereinafter referred to as the "Bowlin et al." application) filed May 28, 1993, which is incorporated herein by reference, since similar means are used in the present invention.

Each can is transported into a horizontal working position aligned with a tooling ram by a starwheel. A can push ram is then actuated by a push ram drive cam to engage the open or "top" end of the aligned can to move it axially toward the tooling ram by pushing the can axially toward the reforming roller on the tooling ram. When the can push ram has reached its full stroke, the can, which is still on the starwheel, is in work position to be reformed. A dome receptacle mounted on the axial end of each tool turret closest to the starwheel acts as a jig for peripherally engaging and supporting the bottom of the can. A peripheral profile portion of the jig mates with an outer annular wall on the bottom of the can. With the base of the can supported on the dome receptacle of the tooling ram, the reforming roller is moved in a radially outward direction to contact the inner periphery of the convex U-shaped ridge on the bottom of the can. The reforming roller is moved radially as well as in an orbit about the central axis of the can as a result of axial and rotary movement of a cam mounting block attached to the tooling ram.

Thus, the present invention includes each tooling ram having an inside base reforming roller, a roller mounting block for supporting the roller to travel along a circular orbital path of varying diameter in a plane perpendicular to the can central axis and having a center of curvature positioned coextensive with the can central axis, guide cams that ride along cam surfaces formed in slots in the roller mounting block, a cam mounting block supporting the guide cams, and a tooling drive shaft which is connected to the cam mounting block and rotates the cam mounting block about its axis coextensive with the can axis while the tooling drive shaft is supported rotatably in and moved axially with a tooling drive ram assembly that moves axially along the central axis toward or away from the can.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
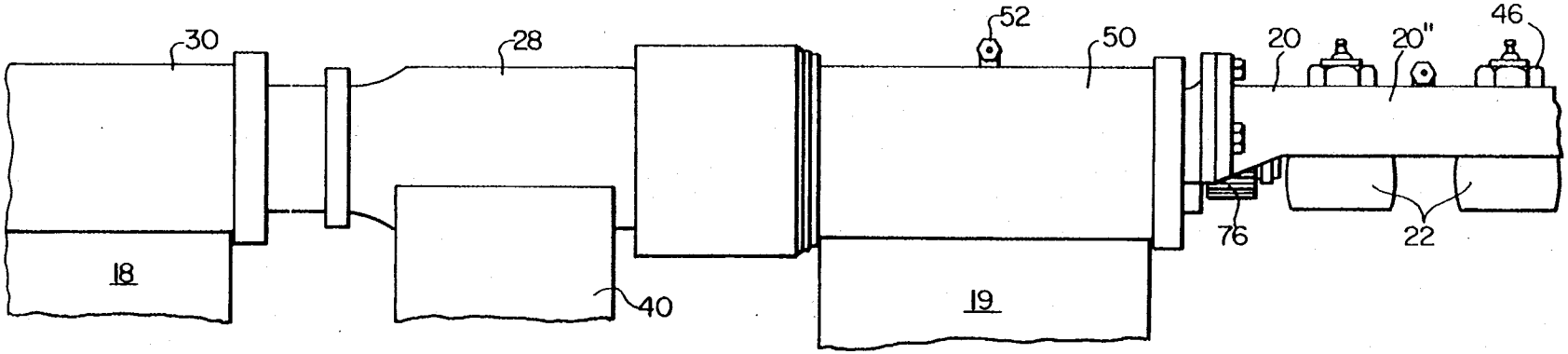
FIG. 1 illustrates a fragmentary front elevation view of the uppermost one of the processing stations of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
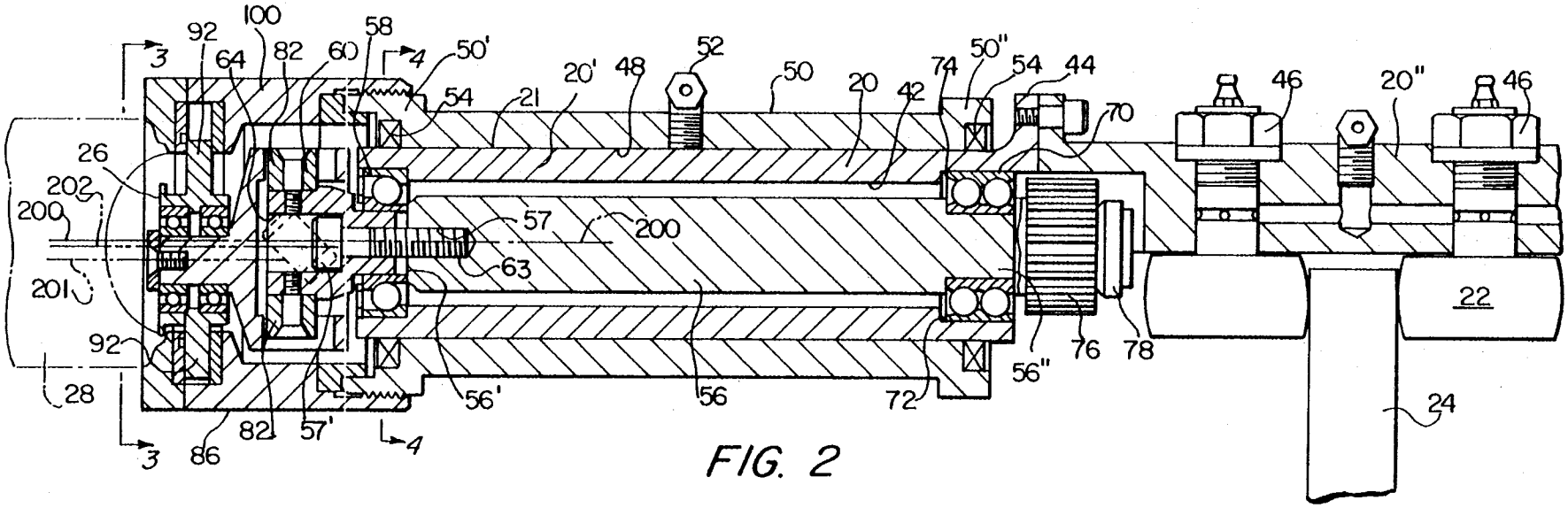
FIG. 2 is a vertical longitudinal cross-sectional view of a tooling ram of FIG. 1.
Figure 3:
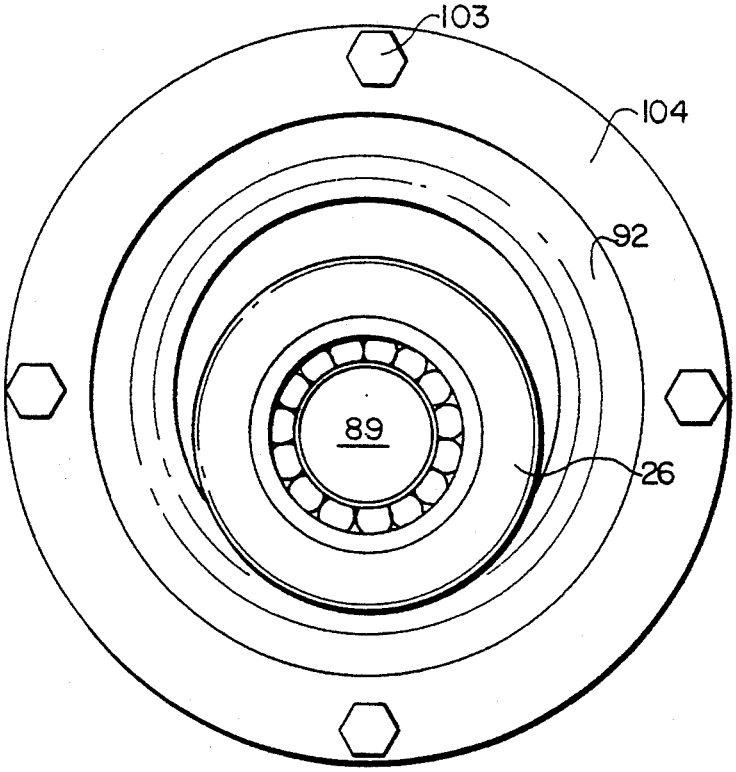
FIG. 3 is an end view of the tooling ram taken along line 3—3 of FIG. 2.

FIG. 1 shows a portion of one of the plurality of identical processing stations that constitutes the present invention. A tool drive ram assembly 20 is shown activated by reactive engagement of cam followers 22 with a fixed cam 24 (FIG. 9) so that a reforming roller 26 is contacting the inner periphery of the annular rim at the bottom of a can 28 (as shown in FIG. 2). Can 28 is held in position between the tool drive ram assembly 20 and a can push ram 30 by a conventional starwheel 40 which can optionally be a vacuum starwheel if desired. A fixed cam 31 provides the small amount of reciprocation required by push ram 30 for positioning the can bottom end for working and for permitting subsequent discharge of the can from starwheel 40.

Figure 10:
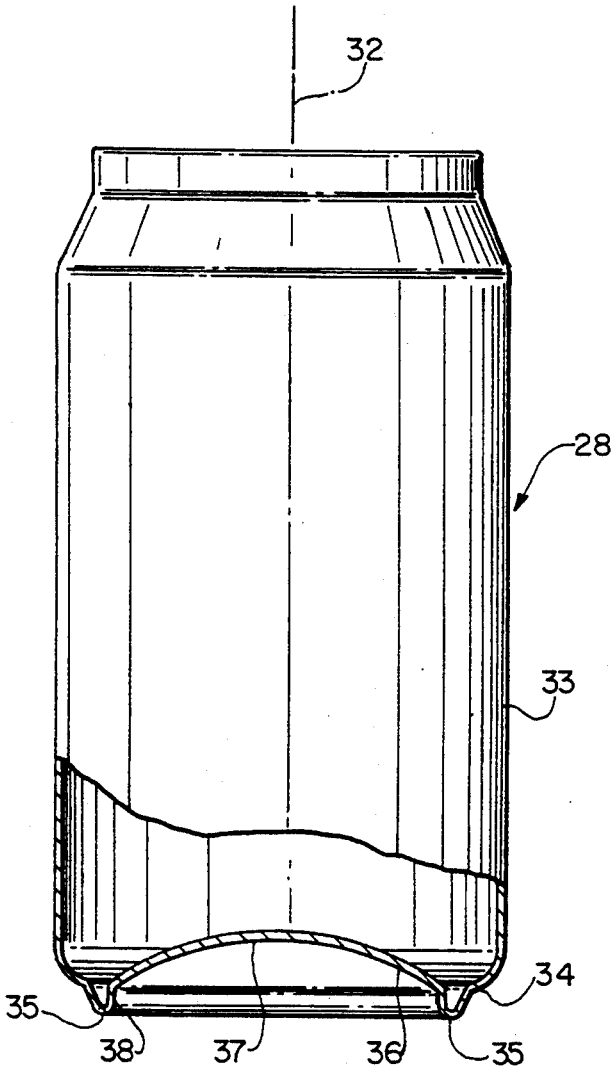
FIG. 10 is an elevation view partially in section of a container which is suitable for treatment by the process and apparatus of the invention.
Figure 11:
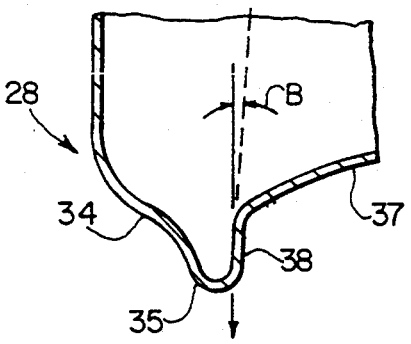
FIG. 11 is an enlarged view of the lower left hand corner of the container of FIG. 10, prior to reforming.
Figure 12:
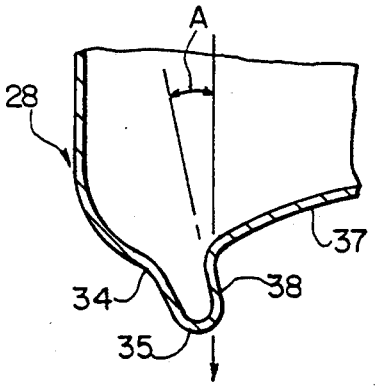
FIG. 12 is an enlarged view of the lower left hand corner of the container of FIG. 10, after reforming.

As described in the ANC patent, and shown in FIGS. 10–12, a typical can to be worked 28 is symmetrical about a vertical axis 32. A generally cylindrical side wall 33 parallel with this vertical axis forms the panel on which graphics may be printed. An outer annular wall 34 forms a transitional portion between this side wall 33 and a convex, U-shaped portion 35 that defines a flange-like ridge at the base of can 28. Can 28 also includes a preformed bottom wall 36 including a center domed portion 37. An annular, substantially vertical wall 38 joins domed portion 37 to convex U-shaped portion 35. This substantially vertical wall has a positive angle B sloping towards vertical axis 32 before reforming—as shown in FIG. 11. After the completion of the reforming operation that is described in detail below, substantially vertical wall 38 has a negative angle A sloping away from vertical axis 32.

The preferred embodiment of the invention employs a plurality of tool drive ram assemblies 20 each of which is supported for rotation on radial supports 18 and 19 radially mounted on a main support shaft 23 which is supported for driven rotation on the main frame 25 of the apparatus in the manner of the main shaft of the Bowlin et al. application. Each tool drive ram assembly 20 has a first end 20′ and a second end 20″ as shown in FIG. 2. First end 20′ of tool drive ram assembly 20 is substantially cylindrical in shape and has a central axis 200 and a central axial bore 42 concentric to axis 200 passing therethrough. Ram assembly first end 20′ is connected to ram assembly second end 20″ by an intermediate connecting portion 44.

Cam followers 22 are secured to ram assembly second end 20″ by cam follower retainer nuts 46. Cam followers 22 move along the surface of fixed cam 24 (shown in FIG. 9) as the tooling ram turret is rotated about its center support means. Movement of cam followers 22 along this cam surface causes tool drive ram assembly 20 to reciprocate along central axis 200 concentric to axial bore 42 through ram assembly first end 20′ toward and away from starwheel 40 and a can 28 thereon.

End 20′ of tool drive ram assembly 20 is concentrically and slidably received within an axial bore 48 in a slide bushing 50 supported on radial support 19 as shown in FIGS. 1 and 2. Slide bushing 50 is also substantially cylindrical in shape and has a first end 50′ and a second end 50″. The outer cylindrical periphery 21 of tool drive ram assembly first end 20′ matingly fits closely to the inner surface of bore 48 of slide bushing 50. A smooth fit between slide bushing 50 and the tool drive ram assembly 20 is ensured by the presence of grease applied to their mating surfaces through grease fitting 52, and sealed against escaping from the space between their mating surfaces by oil seals 54 provided at each end of slide bushing 50.

Figure 4:
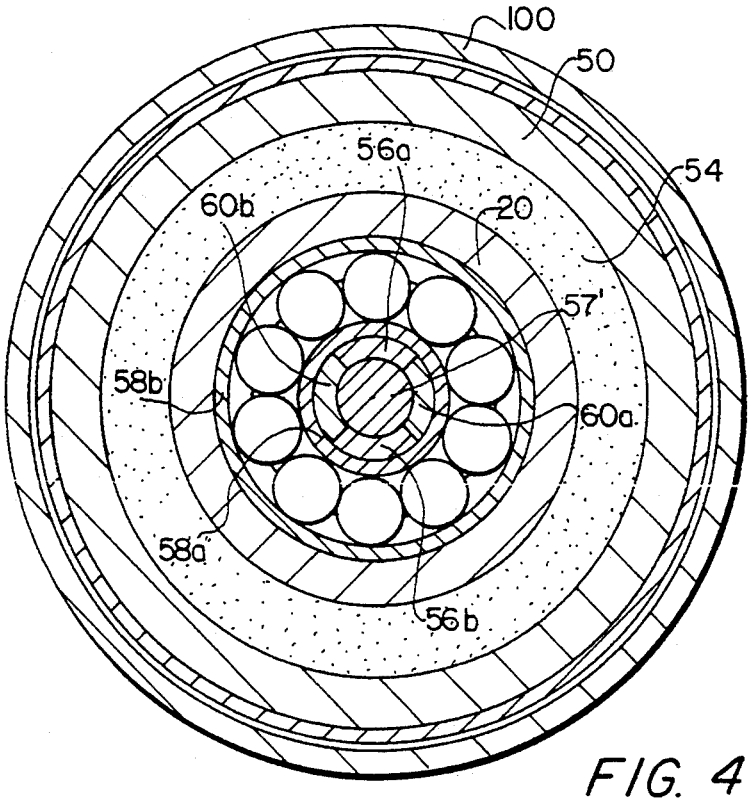
FIG. 4 is a transverse section taken along lines 4—4 of FIG. 2 through the ball bearing assembly supporting one end of the tooling drive shaft.
Figure 5:
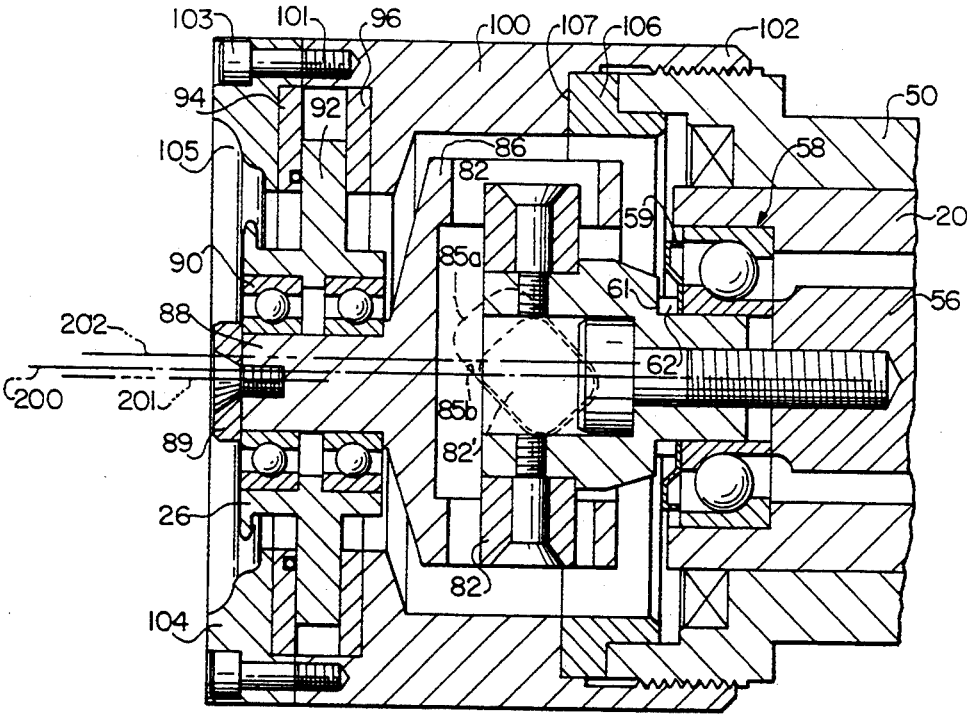
FIG. 5 is a cross-sectional view showing the reforming roller in its fully retracted position.

As shown in FIG. 2, a tooling drive shaft 56 is concentrically mounted relative to axis 200 for rotation within ram assembly first end 20′. Tooling drive shaft 56 is located within ram assembly central axial bore 42 and has a first end 56′ and a second end 56″. As shown in FIG. 2 and FIG. 4, tooling drive shaft first end 56′ is rotatably supported in ram assembly first end 20′ by an angular contact type ball bearing assembly 58, which allows the transmittal of axial thrust forces from ram assembly 20 to a cam mounting block 60. Inner race 58*a* of ball bearing assembly 58 is covered by bearing cap 59 (as shown in FIGS. 5 and 6) and rests against a spacer 62 which separates inner bearing race 58*a* from an annular shoulder 61 on the cam mounting block 60.

Tooling drive shaft second end 56″ is supported in tooling ram assembly 20 by a self-aligning type ball bearing assembly 70—as shown in FIG. 2. Self-aligning ball bearing assembly 70 is separated from a shoulder 72 in ram assembly 20 by "Belleville" washers 74. Self-aligning ball bearing assembly 70 compensates for any minor misalignments between tooling drive shaft 56 and tooling ram assembly 20 and applies pre-load force to bearing 70.

Figure 9:
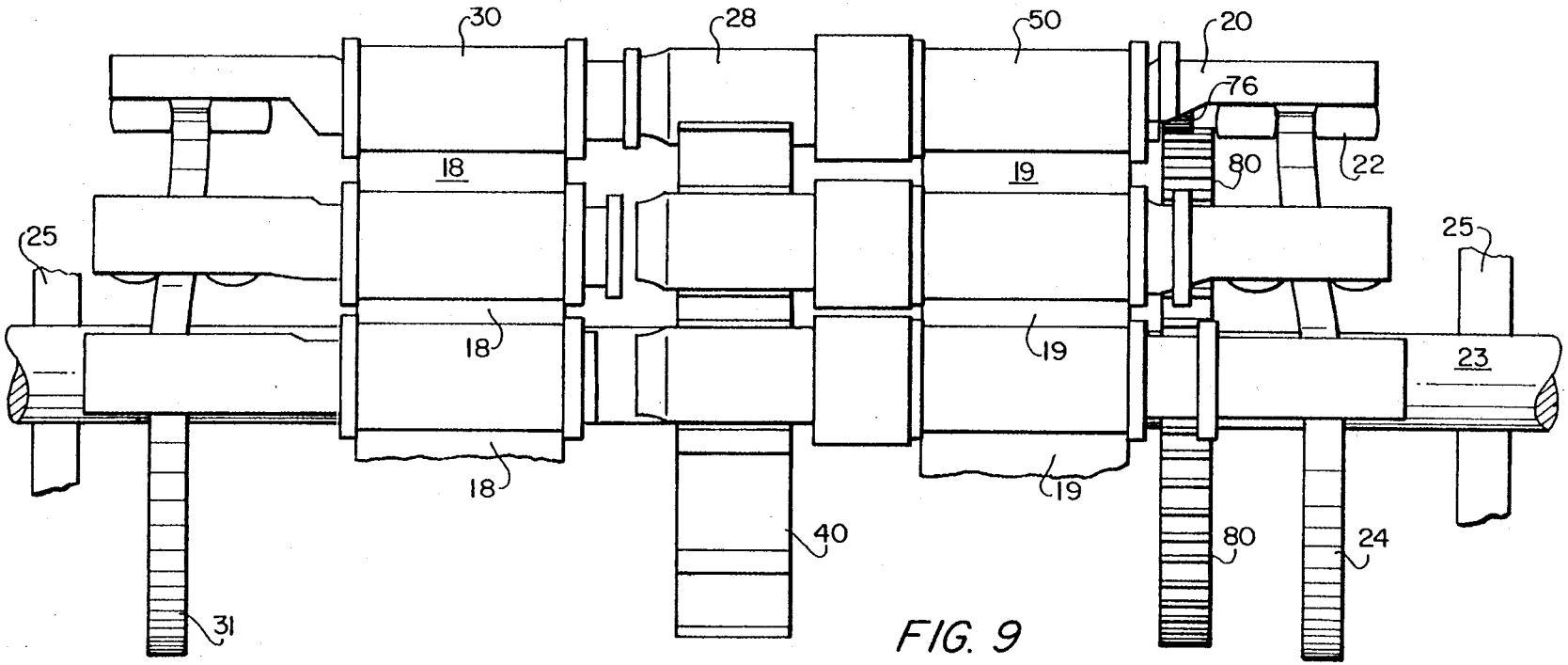
FIG. 9 is a partial front elevation view taken in the direction of arrows 9—9 in FIG. 8.

As shown in FIG. 2, a pinion drive gear 76 is keyed to tooling drive shaft second end 56″. Pinion drive gear 76 is held on tooling drive shaft second end 56″ by a bearing lock nut 78. Pinion drive gear 76, along with each of the pinion drive gears provided on the other tooling ram assemblies of a single turret on which assembly 20 is mounted, is engaged with a single large central bull gear 80 fixedly attached to the main frame of the apparatus (FIG. 9). Tooling drive shaft 56 is rotated by the orbital rotation of pinion drive gear 76 around fixedly positioned bull gear 80 which is fixedly attached to and supported by the frame of the apparatus. Such rotation of drive shaft 56 consequently rotates cam mounting block 60.

Figure 7:
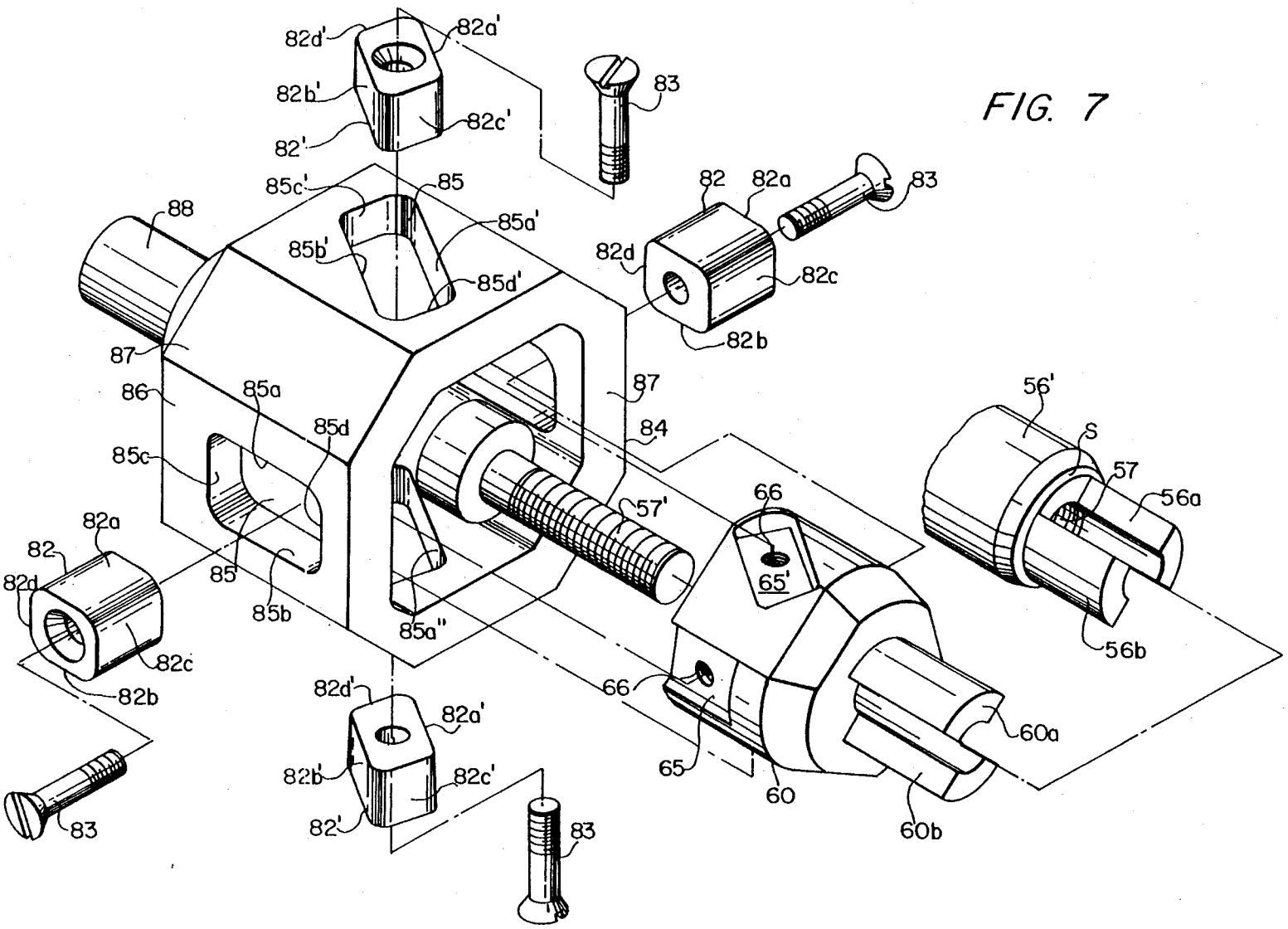
FIG. 7 is an exploded perspective view of the working assembly.
Figure 8:
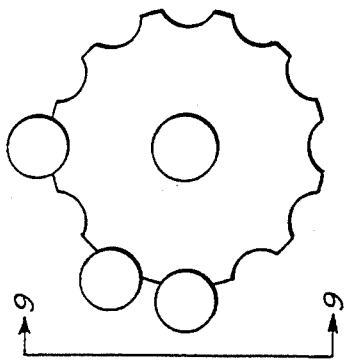
FIG. 8 is a partial end view taken through the starwheel and showing three of the tooling rams circumferentially spaced in a single tool turret.

As shown in FIG. 7, tooling drive shaft first end 56' has two circumferentially spaced, axially extending tangs 56*a* and 56*b*. These tangs are spaced 180° apart from each other and extend axially from an annular shoulder S at the tooling drive shaft first end 56'. A blind bore 57 extends axially inwardly from first end 56' of tooling drive shaft 56. Blind bore 57 is internally threaded for mating threaded engagement with a cam mounting block screw 63 as shown in FIG. 2.

Cam mounting block 60 also has two circumferentially spaced, axially extending tangs 60*a* and 60*b* as shown. Tangs 60*a* and 60*b* are spaced 180° apart from each other and are interleaved with tangs 56*a* and 56*b* of the tooling drive shaft 56 when cam mounting block 60 is connected to tooling drive shaft 56 by screw 63 as shown in FIG. 2. The central axis of cam mounting block 60 is coincident with central axis 200 of tooling drive shaft 56. Cam mounting block screw 63 is seated in an axially extending counterbore 64 (FIG. 2) of cam mounting block 60. The threaded portion of screw 63 engages with internally threaded blind bore 57 of tooling drive shaft 56.

The remaining portion of cam mounting block 60 that extends axially from cam mounting block tangs 60*a* and 60*b*, is substantially cylindrical in shape with two axially parallel flat bottom recesses 65 machined into its outer periphery and spaced *180°* apart from each other, as best shown in FIG. 7. Similarly, two skewed flat bottom recesses 65' are provided on opposite sides from each other between recesses 65. Two parallel guide blocks 82 are mounted in recesses 65 and two skewed positioner cams 82' are mounted in recesses 65'. Guide blocks 82 and skewed positioner cams 82' are substantially square or rectangular in cross-section and extend radially outwardly from cam mounting block 60. Guide blocks 82 fit snugly within flat bottom recesses 65 in cam mounting block 60. Similarly, skewed positioner cams 82' are snugly fitted in skewed recesses 65' in cam mounting block 60 as shown in FIG. 7. Screws 83 pass through the guide blocks 82 and positioner cams 82' along the central axis of each and are threadedly received into threaded bores 66 that pass through cam mounting block 60 from flat bottom recesses 65 and 65' into cam mounting block counterbore 64 (FIG. 2).

Guide blocks 82 each have two substantially flat slide surfaces 82*a* and 82*b* and two substantially flat end surfaces 82*c* and 82*d* on their outer periphery. Similarly, skewed positioner cams 82' have slide surfaces 82*a'* and 82*b'* and end surfaces 82*c'* and 82*d'*. Guide blocks 82 are located 180° from each other and are mounted to cam mounting block 60 with their slide surfaces 82*a* and 82*b* lying on planes parallel to central axis 200 of cam mounting block 60. The two skewed positioner cams 82' are also located 180° from each other and are positioned with their skewed guide slide surfaces 82*a'* and 82*b'* lying on planes that are skewed from central axis 200 of cam mounting block 60.

Guide blocks 82 have their centers aligned with axis 200 and project radially outwardly through guide slots 85 provided in mounting block wall portions 86 and 87 on opposite sides of a roller mounting block 84. Guide blocks 82 support roller mounting block 84 for radial shifting on the guide blocks 82 between an inner position shown in FIG. 5 and an outer or eccentric position shown in FIG. 6. Movement of mounting block 84 between its inner and outer positions is effected by the reaction of skewed cams 82' with surfaces 85*a'* and 85*b'* of slots 85'.

Roller mounting block 84 includes a roller mounting block shaft portion 88 having a central axis 201 (FIGS. 5 and 6) and a roller mounting block guide portion 86 having a central axis 202. Roller mounting block guide portion 86 is substantially octagonal in shape and roller mounting block guide slots 85 and 85' pass through four of the eight side walls 87 spaced 90° apart from each other. Guide slots 85 are substantially rectangular in shape and are each dimensioned with two opposing guide slot guiding surfaces 85*a* and 85*b* spaced apart to allow for a sliding fit with two opposing guide surfaces 82*a* and 82*b* of guide blocks 82. End surfaces 85*c* and 85*d* are provided in slots 85; similarly, end surfaces 85*c'* and 85*d'* are provided in slots 85'.

Roller mounting block shaft portion 88 is substantially cylindrical in shape and extends with its central axis 201 parallel and eccentric to central axis 202 of roller mounting block guide portion 86, as shown in FIGS. 5 and 6. Roller mounting block shaft portion 88 supports reforming roller 26 through two ball bearings 90 that are held in position on shaft portion 88 by cap screw 89 shown in FIG. 5.

A central radially extending support flange 92 of reforming roller 26 is sandwiched in between an outer roller guide 94 and an inner roller guide 96 that allow support flange 92 and reforming roller 26 to move radially, in a plane perpendicular to central axis 200 of tooling drive shaft 56, but not axially. Inner roller guide 96 and outer roller guide 94 are supported in a roller guide housing 100 that is substantially cylindrical in shape and has an outer end 101 and an inner end 102, as shown in FIGS. 5 and 6.

Roller guide housing inner end 102 has internal threads that are engaged with external threads on slide bushing first end 50'. A roller guide housing spacer 106, as best shown in FIGS. 5 and 6, is positioned between an annular shoulder 107 spaced axially inwardly from roller guide housing inner end 102, and slide bushing first end 50'. Roller guide housing outer end 101 provides a support surface for a dome receptacle 104 which acts as a support for can 28. Dome receptacle 104 is removably attached to roller guide housing 100 by dome receptacle bolts 103 and may be interchanged with another dome receptacle having a different shape and/or dimensions to accommodate containers having various different lower end configurations.

Each dome receptacle 104 is manufactured so as to accommodate and support a given size container 28. Accordingly, a bottom peripheral profile portion 105 of the dome receptacle 104 substantially corresponds in shape to outer annular wall 34 of container 28 as explained above and in the ANC patent. Dome receptacle 104 also clamps annular outer roller guide 94, reforming roller support flange 92 and annular inner roller guide 96 against roller guide housing outer end 101, thereby ensuring the precise axial position of reforming roller 26 relative to can 28 supported on bottom peripheral profile surface 105.

Outer roller guide 94 and inner roller guide 96 along with roller guide housing 100 and slide bushing 50 ensure that travel of reforming roller 26 will be limited to a single plane perpendicular to central axis 201 of roller mounting block shaft portion 88. Because central axis 201 of roller mounting block shaft portion 88 is parallel and eccentric to central axis 202 of roller mounting block guide portion 86, rotation of roller mounting block guide portion 86 results in reforming roller 26 orbiting central axis 202 of roller mounting guide portion 86.

Roller mounting block guide portion 86 is rotated by the rotation of cam mounting block 60 which is engaged with tooling drive shaft 56 through tangs 60*a*, 60*b*, 56*a*, and 56*b*. Rotation of cam mounting block 60 transmits a rotational force through guide blocks 82 and skewed positioner cams 82' to roller mounting block 84.

After a can 28 has been brought into position for processing, and is held in position on bottom peripheral profile surface 105, cam mounting block 60 is moved axially to the left as viewed in FIG. 5 along axis 200 towards can 28 by the cooperation of cam followers 22 with stationary cam 24. Tool drive ram assembly 20 transmits this axial movement to cam mounting block 60 through angular contact ball bearing assembly 58 and cam mounting block spacer 62.

Tooling drive shaft 56, and therefore cam mounting block 60, is continuously rotated by pinion drive gear 76, which is always meshed with large fixed central bull gear 80 (shown in FIG. 9). Therefore, reforming roller 26 continues to traverse a closed path and orbit the axis 200 of tooling drive shaft 56 even as the diameter of its closed path is varied from its retracted position of FIG. 5 to its extended position of FIG. 6 as a result of the axial movement of tool drive ram assembly 20.

As tool drive ram assembly 20, and therefore cam mounting block 60 is moved axially toward can 28 (toward the fully extended position shown in FIG. 6), skewed positioner cams 82' react against surfaces 85*b'* to force roller mounting block 84 to move in a radial direction (downward as viewed in FIG. 5) on parallel guide blocks 82 as skewed guide slide surfaces 82*b'* of cams 82' slide along mating skewed guide slot guiding surfaces 85*b'* until movement of cam mounting block 60 to the left (as in FIG. 5) is terminated. With tool drive ram assembly 20 in a fully extended (leftward) position (as shown in FIG. 6) roller mounting block shaft portion 88, and therefore reforming roller 26 is moved to its most eccentric position relative to the central axis 200 of tooling drive shaft 56, and reforming roller 26 orbits about a closed path with the largest possible diameter. As reforming roller 26 approaches this position it follows a substantially spiral path. Reforming roller 26 contacts annular, substantially vertical wall 38 on can 28 (shown in FIGS. 10–12) and completes the inside can base reforming operation while in the outermost position defined by the termination of its spiral path.

The radial retraction of reforming roller 26 from its most eccentric position shown in FIG. 6 is effected by the rightward axial retraction of tool drive ram assembly 20 along with cam mounting block 60. Parallel surfaces 82*a* and 82*b* of guide blocks 82 slidingly engage surfaces 85*a* and 85*b* within roller mounting block parallel guide slots 85 and transmit rotational force to roller mounting block 84, but do not provide any of the force in a radial direction for moving reforming roller 26. The radially inward and outward force on reforming roller 26 is created by the skewed guide cam slide surfaces 82*a'* and 82*b'* reaction with skewed surfaces 85*a'* and 85*b'* which convert the axial thrust from cam mounting block 60 into a radial force on roller mounting block 84. The radial movement of mounting block 84 results in the reforming roller 26 following a spiral path as it moves into contact with can 28 and again when retracting from the can.

Retraction of roller 26 from its most eccentric FIG. 6 position begins with movement of cam follower 22 to the right which moves mounting block 60 to the right and causes surfaces 82*a'* of skewed positioner cams 82' to react with surfaces 85*a'* of slots 85' so that shaft 88 is moved radially inward. The provision of skewed positioner cams 82' as well as parallel guide blocks 82 on a single cam mounting block 60, allows for a single actuating means for driving reforming roller 26 along an arcuate path to traverse wall 38 of can 28 and for actuating reforming roller 26 in a radial direction to bring roller 26 into contact with wall 38 and retract it therefrom.

Modifications and variations of the above-described embodiments of the present invention are possible, as appreciated by those skilled in the art in light of the above teachings. For example, the roller mounting block guide portion does not necessarily have to be octagonal, and the guide cams could be circular in cross section. It is therefore to be understood that, within the scope of the appended claims and their equivalents, the invention may be practiced otherwise than as specifically described.

List of Designators

S annular shoulder
18 support
19 support
20 tool drive ram assembly
20' ram assembly first end
20'' ram assembly second end
21 outer peripheral surface of 20'
22 cam followers
23 main shaft
24 fixed cam
25 main frame
26 reforming roller
28 can
30 can push ram
31 fixed cam
33 can side wall
34 can outer annular wall
35 can convex U-shaped portion
36 can preformed bottom wall
37 can center domed portion
38 can annular substantially vertical wall
40 vacuum starwheel
42 took drive ram assembly central axial bore
44 ram assembly intermediate connecting portion
46 cam follower retainer nuts
48 slide bushing axial bore
50 slide bushing
50' slide bushing first end
50'' slide bushing second end
52 grease fitting
54 oil seals
56 tooling drive shaft
56' tooling drive shaft first end
56'' tooling drive shaft second end
56*a* and 56*b* tooling drive shaft tangs
57 tooling drive shaft blind bore
58 ball bearing assembly
58*a* inner race of ball bearing assembly
58*b* outer race of ball bearing assembly
59 bearing cap
60 cam mounting block
60*a* and 60*b* cam mounting block tangs
61 cam mounting block shoulder 62 cam mounting block spacer
63 cam mounting block screw
64 cam mounting block counterbore
65 guide cam recess
65′ skewed recesses
66 cam mounting block threaded bores
70 self-aligning ball bearing assembly
72 ram assembly shoulder
74 Belleville Washers
76 pinion drive gear
78 bearing lock nut
80 bull gear
82 parallel guide blocks
82*a* and 82*b* parallel guide slide surfaces
82*c* and 82*d* parallel guide cam end surfaces
82′ skewed positioner cams
82*a*′ and 82*b*′ skewed guide slide surfaces
82*c*′ and 82*d*′ skewed guide end surfaces
83 guide cam screw
84 roller mounting block
85 roller mounting block parallel guide slot
85*a*′ and 85*b*′ parallel guide slot guiding surfaces
85*c* and 85*d* parallel guide slot end surfaces
85′ roller mounting block skewed guide slot
85*a*″ and 85*b*″ skewed guide slot guiding surfaces
85*c*′ and 85*d*′ skewed guide slot stop surfaces
86 roller mounting block guide portion
87 guide portion side wall
88 roller mounting block shaft portion
89 roller mounting block cap screw
90 roller mounting block ball bearings
92 reforming roller central support flange
94 outer roller guide
96 inner roller guide
100 roller guide housing
101 roller guide housing outer end
102 roller guide housing inner end
103 dome receptacle bolts
104 dome receptacle
105 bottom peripheral profile surface
106 roller guide housing spacer
107 roller guide housing annular shoulder
200 central axis of tooling ram assembly
201 central axis of roller mounting block shaft portion
202 central axis of roller mounting block guide portion

What is claimed is:

1. An apparatus for reforming the base of a cylindrical container having a longitudinal axis, and a substantially vertical wall on the base of the container joining a center domed portion of the base to an annular flange-like ridge on the base, said apparatus comprising:

means for supporting said container;

a reforming roller;

a single actuating means for driving said reforming roller to orbit said longitudinal axis, while moving said roller in a radially outward direction relative to said longitudinal axis, thereby bringing said roller gradually into contact with said substantially vertical wall of said container while traversing and reforming said substantially vertical wall; and means for moving said single actuating means in a direction along an axis coinciding with said longitudinal axis and means for rotating said single actuating means about said axis.

2. The apparatus of claim 1, wherein:

said reforming roller is rotatably supported by mounting means; and said mounting means is supported on said single actuating means and is free to move axially and radially relative to said single actuating means.

3. An apparatus for reforming the base of a cylindrical container having a longitudinal axis, and a substantially vertical wall on the base of the container joining a center domed portion of the base to an annular flange-like ridge on the base, said apparatus comprising:

a means for supporting said container;

a tool drive ram assembly having a first end, a second end, a central axis that is coincident with said container longitudinal axis, and a central axial bore;

a substantially cylindrical, ram slide bushing having a first end, a second end, a central axis, and an axial bore through which said tool drive ram assembly is concentrically and slidably received for axial reciprocation;

a tooling drive shaft concentrically mounted for rotation within the tool drive ram assembly central axial bore and having a first end, a second end and a central axis coinciding with the tool drive ram assembly central axis;

a reforming roller having a central axis and a radially extending flange portion;

a roller mounting block rotatably supporting said reforming roller for movement of said roller along an orbital path about said container longitudinal axis and bringing said roller into contact with said substantially vertical wall of said container while traversing and reforming said substantially vertical wall;

said roller mounting block having an outer periphery, a recess extending axially inwardly from one axial end, and a plurality of guide slots extending radially therethrough from said recess to said outer periphery;

a plurality of guide blocks and positioner cams slidably received within said guide slots; and a cam mounting block holding said guide blocks and positioner cams in rigid, circumferentially-spaced relationship, with said cam mounting block being fixedly connected to said tooling drive shaft first end and extending into said roller mounting block recess.

4. The apparatus of claim 3, further including:

two annular bearing plates spaced apart axially and slidably receiving therebetween said reforming roller radially extending flange portion;

a substantially cylindrical roller guide housing having a central axis, a first end, and a second end connected to the ram slide bushing first end with the roller guide housing central axis coinciding with the ram slide bushing central axis; and an annular dome receptacle having a peripheral profile portion for supporting the base of the container, said dome receptacle being bolted to the roller guide housing first end with said annular bearing plates and said reforming roller radially extending flange portion retained axially therebetween.

5. The apparatus of claim 4 further including a roller guide housing spacer positioned axially between said ram slide bushing first end and an annular shoulder spaced axially inwardly from said roller guide housing second end; and a cam mounting block spacer positioned axially between said cam mounting block and said tooling drive shaft first end.

6. The apparatus of claim 3 wherein said tooling drive shaft includes a blind, internally threaded bore extending in from said tooling drive shaft first end along said tooling drive shaft central axis; and said apparatus further including:

a pinion drive gear fixedly retained on and keyed to said second end of said tooling drive shaft;

said tooling drive shaft first end including two circumferentially spaced tangs extending in an axial direction from an annular shoulder that is orthogonal to and surrounding said blind, internally threaded bore;

said cam mounting block including a first end, a second end, a central axial bore, and an outer periphery, with said second end including two circumferentially spaced tangs extending in an axial direction from an annular shoulder that is orthogonal to and surrounding said cam mounting block central axial bore;

a cam mounting block spacer seated against said cam mounting block annular shoulder and providing means for axially spacing said cam mounting block from said tooling drive shaft first end;

said cam mounting block being fixed to said tooling drive shaft first end by a screw passing through said cam mounting block central axial bore and threadedly received in said tooling drive shaft blind bore; and said cam mounting block tangs interleaved with said tooling drive shaft tangs.

* * * * *

UNITED STATES PATENT AND TRADEMARK OFFICE

CERTIFICATE OF CORRECTION

PATENT NO. : 5,433,098

DATED : July 18, 1995

INVENTOR(S) : Geoffrey R. Bowlin et al.

Figure 6A:
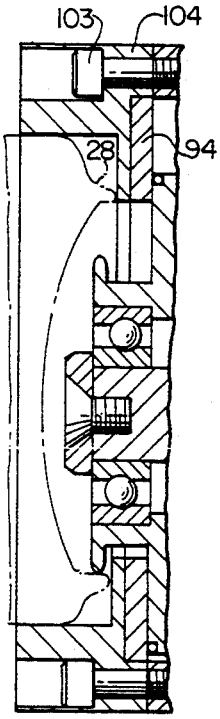
FIG. 6 is a cross-sectional view showing the reforming roller in its fully extended position.
Figure 6:
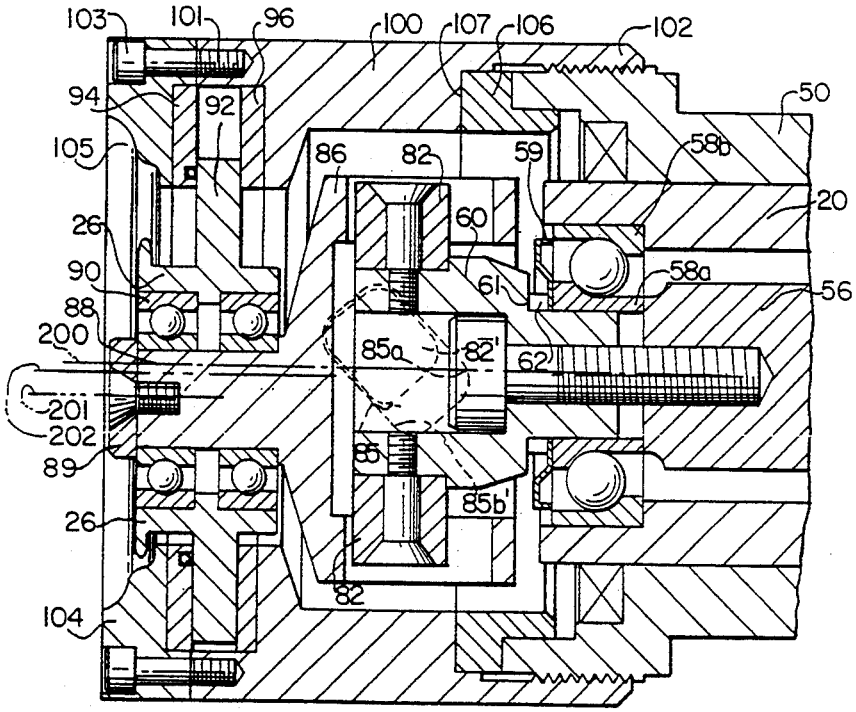

It is certified that error appears in the above-indentified patent and that said Letters Patent is hereby corrected as shown below:

In The Drawings:

Please delete "Figure 6A" of the drawings.

Signed and Sealed this

Sixteenth Day of January, 1996

Bruce Lehman

*Attest:*

BRUCE LEHMAN

*Attesting Officer*

*Commissioner of Patents and Trademarks*